United States Patent [19]

Fieldstad, Jr. et al.

[11] 3,997,778

[45] Dec. 14, 1976

[54] LUMINAIRE OPTICAL SYSTEM

[75] Inventors: Donald Fieldstad, Jr., Greendale; Donald Wandler, South Milwaukee, both of Wis.

[73] Assignee: McGraw-Edison Company, Elgin, Ill.

[22] Filed: Oct. 10, 1975

[21] Appl. No.: 621,411

[52] U.S. Cl. ..... 240/41.35 E; 240/25; 240/41 B; 240/41.35 R; 240/41.35 F; 240/103 R; 240/103 B

[51] Int. Cl.[2] ..... F21V 7/00

[58] Field of Search ..... 240/25, 41 R, 41 B, 240/41.35 R, 41.35 C, 41.35 E, 41.35 F, 41.36, 41.37, 103 R, 103 B

[56] References Cited

UNITED STATES PATENTS

| | | | |
|---|---|---|---|
| 2,522,230 | 9/1950 | Komulaine | 240/36 |
| 3,001,061 | 9/1961 | Moore | 240/41.35 R |
| 3,167,258 | 1/1965 | Wilde | 240/41.35 E |
| 3,176,124 | 3/1965 | Cibie | 240/41.35 R |
| 3,610,915 | 10/1971 | Moore | 240/41.35 R |
| 3,686,495 | 8/1972 | Medley | 240/41.35 E |
| 3,745,326 | 7/1973 | Hernandez | 240/41.35 E |

*Primary Examiner*—Russell E. Adams, Jr.
*Attorney, Agent, or Firm*—Jon Carl Gealow

[57] ABSTRACT

An optical system for a luminaire, such as an outdoor floodlight, is provided by an assembly of reflectors. The main reflector assembly has a simply curved preformed back component and a pair of side components that are formed in the desired shape by forcing them into place between appropriate holding members in the luminaire housing. Top and bottom reflector components may be added to provide improved optical efficiency, improved appearance and separation thermally, mechanically and electrically between the optical chamber and other portions of the luminaire. All reflector components may be made of thin gauge prefinished reflector stock.

15 Claims, 5 Drawing Figures

LUMINAIRE OPTICAL SYSTEM

BACKGROUND OF THE INVENTION

1. Field of the Invention

This invention relates generally to an optical assembly for a luminaire, and more specifically, this invention relates to a system of reflector components to provide the desired light distribution and lighting efficiency for an outdoor floodlight.

2. Description of the Prior Art

In utilizing an outdoor floodlight, it is necessary to utilize some type of light collection and focusing system to obtain the desired lighting efficiency and light distribution. Such light control or optical systems conventionally utilize metallic reflectors, the best known of which, perhaps, is the parabolic reflector in its various sizes and shapes. Such reflectors are made of relatively heavy material and must be preformed in the desired shape. The use of such relatively heavy stock and the preforming operations make the costs of such reflector systems relatively high. Further, as a result of the working required to get the desired shape, it is frequently necessary to establish the reflecting surface of the metal after it has been preformed. This adds still another increment to the overall cost of the optical system.

In addition, the necessity of the preforming operations means that the manufacture and assembly of the optical system is relatively complex, as is the replacement of the optical system.

While some attempts have been made to utilize a multiplicity of reflector elements to produce the desired light control, these systems have generally been complex, unwiedly and financially impractical.

SUMMARY OF THE INVENTION

By means of the present invention, the light distribution and lighting efficiency of a luminaire, such as pole-mounted outdoor floodlight, can be achieved by using thin gauge prefinished reflector stock, which greatly diminishes the costs of the system. In addition, the system is not complex or difficult to master and may be easily assembled. Further, the replacement of any damaged or defective reflector components can be easily accomplished.

These desirable results are achieved by utilizing a maximum of only five reflective components, all of which may be made of thin gauge prefinished reflector stock without any complicated preforming. The three basic or main reflector items include a back reflective component and a pair of side reflective components. The top and bottom reflective components are added to improve the optical efficiency of the system, as well as providing a more finished appearance. In addition, the top and bottom reflective components serve to separate the optical chamber from the other portions of the luminaire housing, which has an aperture at the front from which light emanates. All of these reflective components are made from thin gauge prefinished reflector stock.

None of the reflective components must be preformed, and the back reflective component is the only one that is preformed, this preforming providing an arcuate shape with a simple bend about a single axis of curvature, so that the prefinished reflector stock can be utilized without disrupting the reflecting surface. The side reflective components are merely straight sections which are given the desired arcuate shape or form by being inserted between appropriate positioning and holding members, such as a bracket at the back and a retaining flange at the front. As in the case of the back reflective component, the side reflective components are bent about a single axis of curvature, which lies in a vertical plane, so that the reflective finish is not disrupted. Each of the side reflective components are mounted by being placed against the mounting bracket at the back and then bent until the front edge fits in the retaining flange at the front. The retaining flange has an appropriate central cut-out to permit grasping the front edge of the side reflective component to remove it from the luminaire. The side reflective components have reflecting surfaces facing one another. After insertion of the side reflective component, the back reflective component is mounted by appropriate fastening means to cover the back edges of the side reflective components, with the reflecting surface of the back reflective component facing the aperture at the front of the luminaire housing. The fastening means may be any appropriate type of device, such as screws.

The top and bottom reflective components are essentially flat plates of the same thin gauge prefinished reflector stock as the other reflective components. The bottom reflective component is mounted on a mounting rim and fastened in any appropriate fashion to close the bottom of the optical compartment and separate it from a lower compartment that contains the electrical components for energizing the lamp of the luminaire. An opening is formed in this bottom reflective component to permit the base of the lamp to be inserted into a socket that is mounted in the electrical component compartment.

At the top of the optical assembly, the top reflective component is held on top of the side and back reflective components by a suitable biasing arrangement, such as tabs formed from the top reflective component or, as shown herein, a pair of spiral springs exerting a downward force. These springs permit the top reflective component to be pushed upwardly when inserting or removing the lamp from the luminaire, if additional room is needed for such actions.

With the invention disclosed herein, an optical or reflective system for a luminaire is provided which is efficient, inexpensive, easily assembled and easily dismantled for repair or replacement. In addition, the optical assembly disclosed herein provides a luminaire having a nice appearance and one in which the optical chamber is separated from other areas of the luminaire by the reflective components, while at the same time permitting insertion and removal of the lamp of the luminaire through an opening in the bottom reflective component by lifting the top reflective component against the spring bias.

These and other objects, advantages and features of this invention will hereinafter appear, and for purposes of illustration, but not of limitation, an exemplary embodiment of the subject invention is shown in the appended drawing.

DETAILED DESCRIPTION OF THE PREFERRED EMBODIMENT

Figure 1:
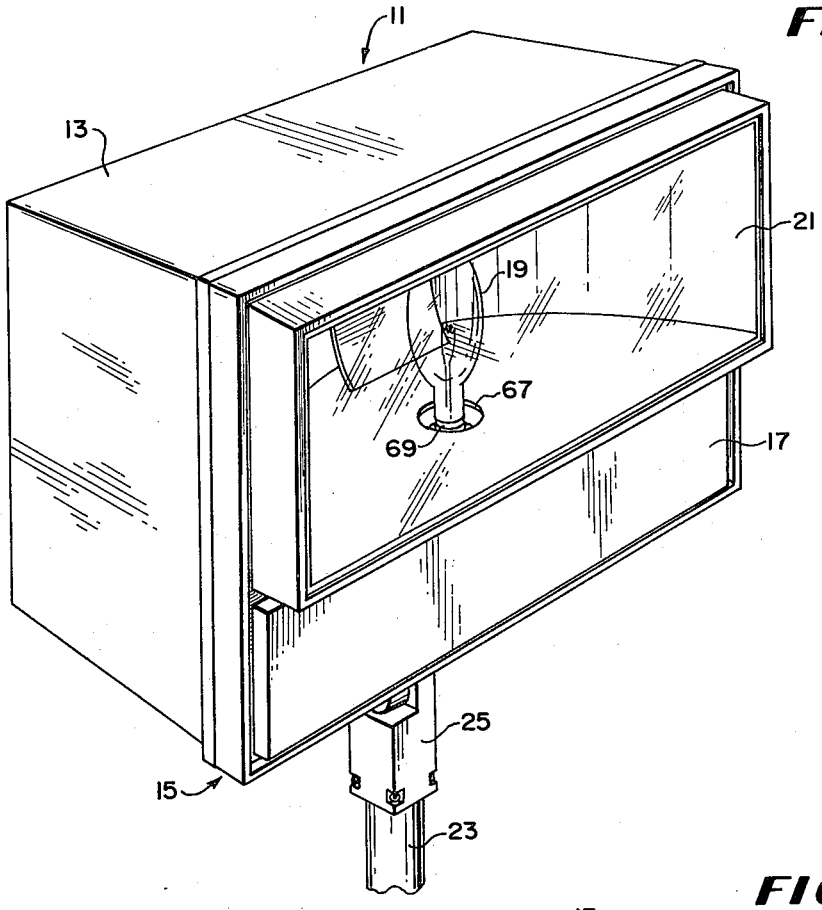
FIG. 1 is a left front perspective view of a luminaire incorporating the optical assembly of this invention.

With reference now to the drawing, a luminaire 11, such as a pole-mounted outdoor floodlight, is illustrated. Luminaire 11 has a housing 13, which is enclosed by a door 15. Door 15 has a bottom opaque portion adjacent a compartment in which the electrical components for energizing a lamp 19 are located. A transparent portion, such as a lens or window 21, is located adjacent the compartment in which the lamp 19 is positioned to produce the desired light, hence providing an aperture from which light emanates. The optical assembly of the present invention is located in the chamber with the lamp 19 to provide the desired light distribution pattern and lighting efficiency. Luminaire 11 is mounted on a pole or tenon 23, by means of a mounting arrangement or fitter 25.

Figure 2:
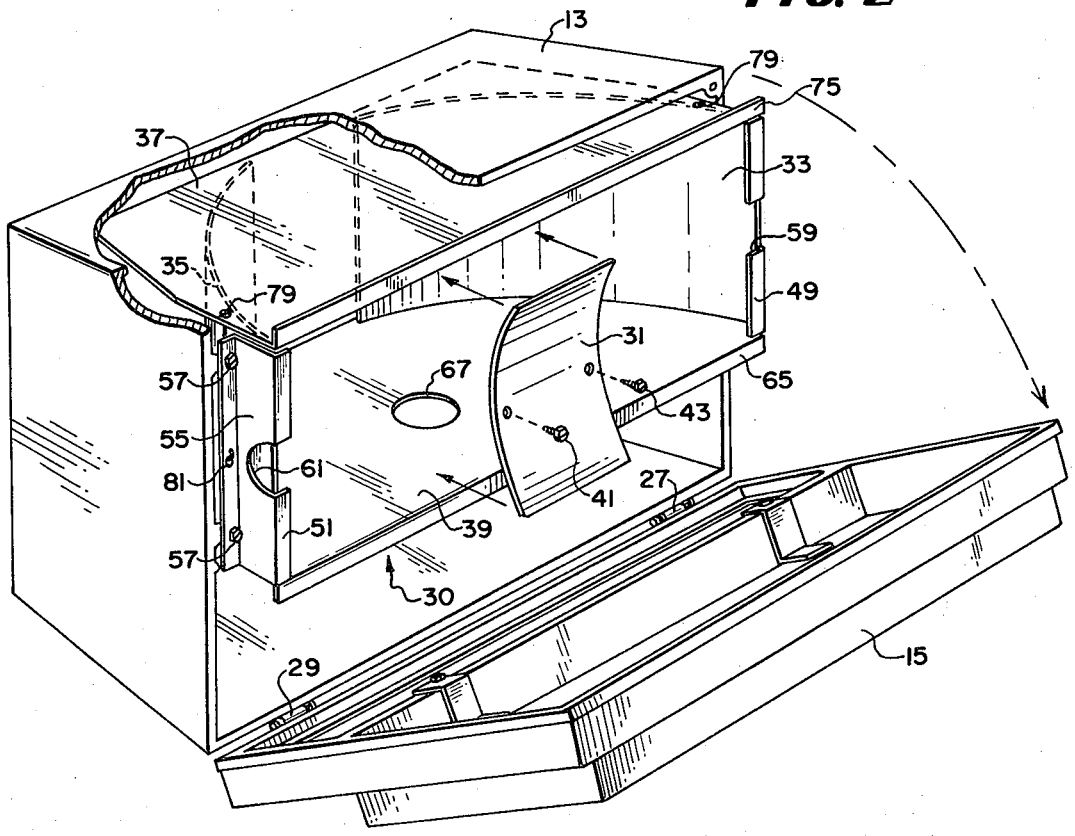
FIG. 2 is a left front perspective view, partially broken away and partially exploded, illustrating the optical assembly in the housing of the luminaire of FIG. 1.

In FIG. 2, the door 15 has been pivoted to an open position about hinges 27 and 29. With the door in this position, and the top of housing 13 partially broken away as shown, the optical assembly 30 may be seen more easily. Optical assembly or system 30 has a main reflector portion that includes a back reflective component 31 and side reflective components 33 and 35. In addition, the optical system 30 includes a top reflective component 37 and a bottom reflective component 39.

Back reflective component 31 is a rectangular piece of thin gauge prefinished reflector stock, which is formed with a desired amount of curvature about a single axis, such axis of curvature lying in a horizontal plane when component 31 is placed in housing 13. Back reflective component 31 could be formed with the desired curvature by forcibly inserting component 31 between appropriate stays. However, in this preferred embodiment, the back reflective component 31 is preformed with the desired curvature. As this curvature is about a single axis, it does not adversely effect the reflective surface of the prefinished stock, which is positioned to face the aperture of lens 21.

Figure 3:
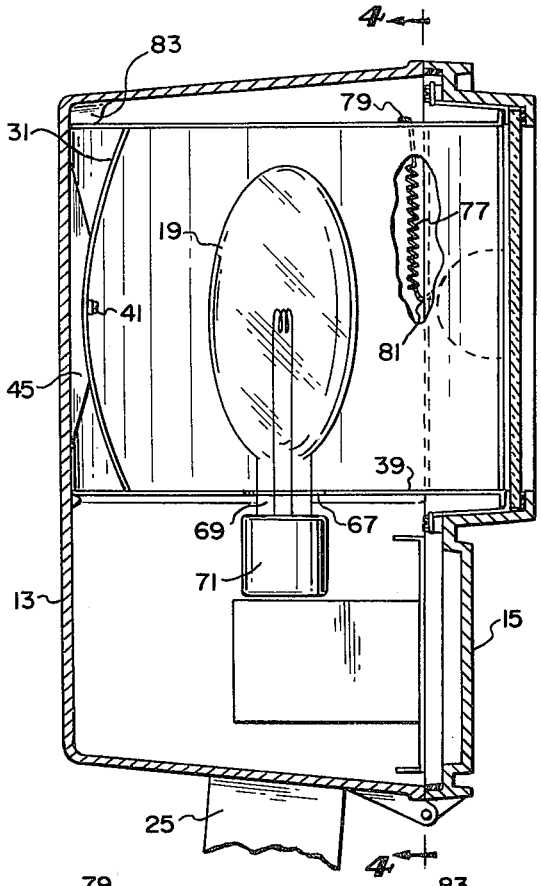
FIG. 3 is a cross-sectional view of the luminaire of FIG. 1, partially broken away.
Figure 4:
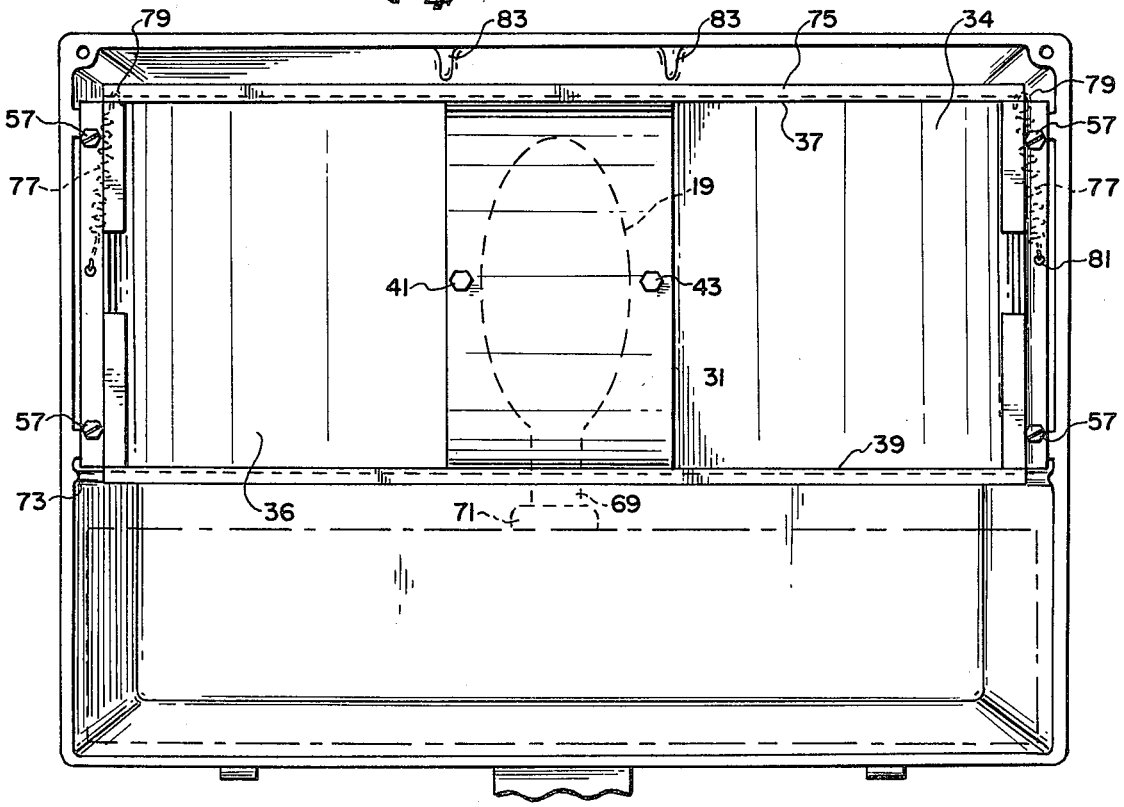
FIG. 4 is a cross-sectional view taken along lines 4—4 of FIG. 3.
Figure 5:
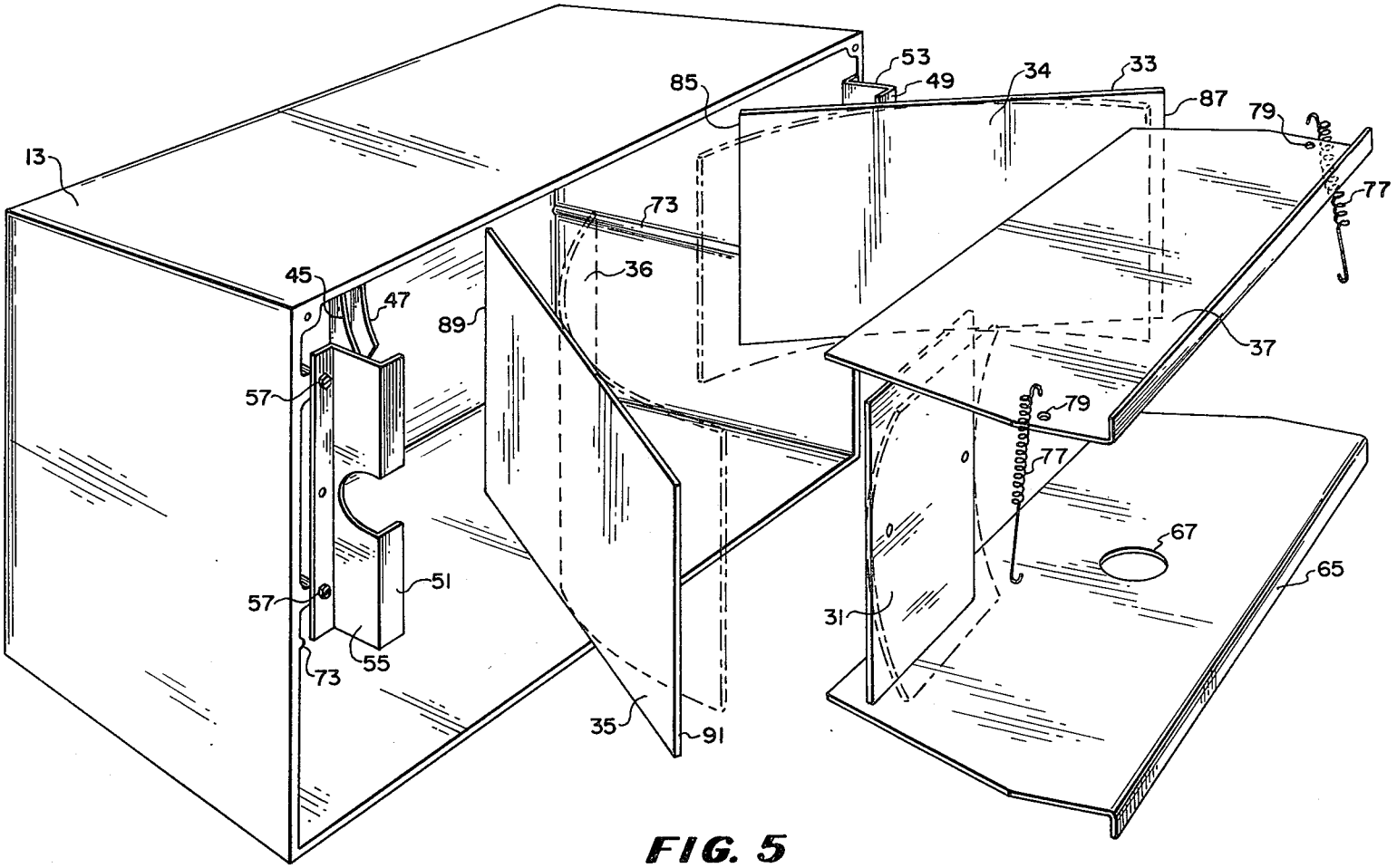
FIG. 5 is an exploded view of the housing of the luminaire of FIG. 1 illustrating the optical assembly of this invention.

The back reflective component 31 is secured in place by an appropriate fastening means, such as screws 41 and 43. Screws 41 and 43 are inserted into a mounting assembly, such as mounting brackets 45 and 47, respectively, as may be better seen in FIGS. 3 and 5. Side reflector components 33 and 35 are flat rectangular sections of thin gauge prefinished reflector stock. The desired curvature of these side reflective components, as illustrated in FIGS. 2 and 5, is achieved by forcibly inserting them in a desired location, where they are retained by an appropriate holding structure. The back edge (i.e., the edge at the back of the open housing 13) of each of the side reflective components 33 and 35 abuts against a respective mounting bracket 45 or 47. The front edges of the side reflective components 33 and 35 are engaged by the retaining flanges 49 and 51, respectively, when the side components are forced into position between the mounting bracket 47 and retaining flange 49, in the case of reflective side component 33, and between mounting bracket 45 and retaining flange 51, in the case of reflective side component 35. The tension of side components 33 and 35 when placed between the respective mounting bracket and retaining flange is sufficient to forcibly retain it in position without further fastening.

Retaining flanges 49 and 51 are located on extending mounting plates 53 and 55, respectively, of the optical system. Extending mounting plates 53 and 55 are firmly secured in housing 13 by appropriate bolts or screws 57. The extending plates 53 and 55, and the retaining flanges 49 and 51, contain cut-away portions 59 and 61. These cut-away portions are for the purpose of permitting a person to grasp in the front edges of the reflective side components for removal from the optical system.

Bottom reflective component 39 is generally planar and shaped to roughly conform to the horizontal cross section of housing 13. A depending flange 39 is located on the front edge thereof, and an opening 67 is provided in the central portion thereof. Opening 67 permits passing of the base 69 of lamp 19 therethrough and is so positioned that the threaded base 69 of the lamp will be inserted into a socket 71 stationed in the compartment below the reflective component 39. Bottom reflective component 39 separates the lighting compartment in which the otpical system is located from this lower compartment, in which the energizing components for the lamp 19 are located.

Bottom reflective component 39 is supported by a mounting rim or ridge 73 located on the inner surface of housing 13. This rim 73 may be cast as an integral portion of the housing. Bottom reflective component 39 is then maintained in position on mounting rim 73 by an appropriate fastening arrangement, such as screws threaded into the projecting mounting plates 53 and 55.

Top reflective component 37 has essentially the same shape as bottom reflective component 39, but with an upwardly extending flange 75. Top reflective component 37 rests on top of the side reflective components 33 and 35 and the back reflective component 31. Component 37 is biased downwardly against the back and side reflective components 31, 33 and 35 by a pair of tension springs 77. Each of the springs 77 extends between an appropriate opening 79 formed on top of reflective component 37 and another opening 81 formed in the projecting mounting plates 53 and 55, the ends of the springs 77 being fastened in the appropriate openings 79 and 81. The biasing of springs 77 holds the top reflective component 37 in place, and yet permits it to be urged upwardly when inserting or removing a lamp 19. Projections 83 at the top back of housing 13, which may be integrally cast with the housing, limit the upward movement of the back end of upper reflective component 37.

With reference to FIG. 5, the assembly of the optical system may be readily observed. Side reflective component 33 is inserted into housing 13 with the reflective surface thereof facing toward the center of the housing. The back end 85 of component 33 is placed against the mounting flange 47, and component 33 is then forcibly urged toward the side wall until the front end 87 thereof fits behind retaining flange 49. When so positioned, side reflective component 33 will have the curvature illustrated in FIG. 5, about an axis of curvature in a vertical plane. Side reflective component 35 is similarly inserted by placing the back end 89 thereof against the mounting flange 45 and bending until the front end 91 will fit behind retaining flange 51, thus, side reflective components 33 and 35 will then have the curvature illustrated in FIG. 5, with the reflecting surfaces 34 and 36 facing one another. The back reflective component 31, which could be arranged to be formed when inserted into the housing 13 as in the case of the side components 33 and 35, is, in this preferred embodiment, preformed to have the curvature illustrated. This back reflective component 31 is then mounted by the screws 41 and 43 inserted into the mounting flanges 45 and 47, so that the back reflective component 31 covers a portion of the back ends of the side reflective components 33 and 35. Bottom reflective component 39 will then be inserted on top of the rim 73 and appropriately fastened in place. Similarly, the top reflective component 37 may be inserted under the protruding stops 83 and then fastened in place by hooking the springs 77 into openings 79 and 81.

With the invention shown and described herein, an optical assembly for a luminaire is provided of a relatively few number of reflective components, each of which is formed from a thin gauge prefinished reflective stock and only one of which is preformed in this preferred embodiment. The reflective components may be easily assembled and easily removed, if repair or replacement is required. Accordingly, a highly efficient and yet relatively inexpensive optical system is produced.

It should be understood that various modifications, changes and variations may be made in the arrangements, operations and details of construction of the elements disclosed herein without departing from the spirit and scope of this invention.

We claim:

1. An optical system for a luminaire comprising:
a first side reflective component formed with a reflecting surface and having a single axis of curvature, said axis of curvature lying in a vertical plane;
a second side reflective component formed with a reflecting surface and having a single axis of curvature, said axis of curvature lying in a vertical plane, said reflecting surfaces of said first and second side reflective components facing one another, with the back ends of said side reflective components being more closely spaced than the front ends thereof; and
a back reflective component formed with a reflecting surface and having a single axis of curvature, said axis of curvature lying in a horizontal plane, said back reflective component positioned over the back ends of said side reflective components.

2. An optical system for a luminaire as claimed in claim 1 wherein all of said reflective components are constructed of prefinished reflector stock.

3. An optical system for a luminaire as claimed in claim 1 wherein said side reflective component are given the desired curvature upon insertion into the luminaire.

4. An optical system for a luminaire as claimed in claim 3 wherein said back reflective component is preformed with the desired curvature.

5. An optical system for a luminaire as claimed in claim 1 and further comprising:
a top reflective component lying in a plane above said back and side reflective components; and
a bottom reflective component lying in a plane below said back and side reflective components, both said top and said bottom reflective components being formed of prefinished reflector stock.

6. An optical system as claimed in claim 5 wherein said top reflective component is spring biased downwardly onto said side and back reflective components.

7. A housing of a luminaire comprising:
a first side reflective component flexed upon mounting in the housing to be forcibly retained in position with an arcuate shape about an axis of curvature lying in a vertical plane;
a second side reflective component flexed upon mounting in the housing to be forcibly retained in position with an arcuate shape about an axis of curvature lying in a vertical plane;
an aperture from which light emanates formed at one end of the housing, said side reflective components having front ends thereof adjacent said aperture and back ends thereof spaced from said aperture;
reflecting surfaces established on said side reflective components, said side reflective components being mounted with said reflecting surfaces facing one another, said back ends of said side reflective components being spaced closer than said front ends thereof;
a back reflective component mounted over said back ends of said side reflective components, said back reflective component having an arcuate shape about an axis of curvature lying in a horizontal plane; and
a reflecting surface established on said back reflective component, said reflecting surface facing said aperture.

8. A housing of a luminaire as claimed in claim 7 and further comprising:
a top reflective component positioned on top of said side and said back reflective components;
a bottom reflective component positioned below said side and said back reflective components; and
reflecting surfaces established on said top and said bottom reflective components, said reflecting surfaces facing one another.

9. A housing of a luminaire as claimed in claim 8 wherein all of said reflective components are constructed of prefinished reflector stock.

10. A housing of a luminaire as claimed in claim 8 and further comprising spring means for biasing said top reflective component down toward said side and back reflective components.

11. A housing of a luminaire as claimed in claim 7 wherein said back reflective component is preformed with the desired curvature.

12. A housing of a luminaire comprising:
a first side reflective component constructed of prefinished reflector stock with a reflecting surface established thereon;
first holding means positioned in the housing, said first side reflective component being flexed upon insertion into said first holding means to assume an arcuate shape about an axis of curvature lying in a vertical plane, the flexure of said first reflective component forcibly retaining said component in said first holding means;
a second side reflective component constructed of prefinished reflector stock with a reflecting suface established thereon;
second holding means positioned in the housing, said second side reflective component being flexed upon insertion into said second holding means to assume an arcuate shape about an axis of curvature lying in a vertical plane, the flexure of said second side reflective component forcibly retaining said component in said second holding means;

a back reflective component constructed of prefinished reflector stock with a reflecting surface thereon, said back reflective component being preformed into an arcuate shape;

an aperture from which light emanates formed at one end of the housing, said side reflective components having front ends adjacent opposing sides of said aperture and back ends spaced therefrom with said reflecting surfaces thereof facing one another, said front ends of said side reflective components being spaced farther apart than said back ends, and said back reflective component positioned over said back ends of said side reflective components with said reflecting surface thereof facing said aperture and the arcuate shape thereof being about an axis of curvature lying in a horizontal plane;

a bottom reflective component constructed of prefinished reflector stock with a reflecting surface thereon, said bottom reflective component mounted below said side and back reflective components on a mounting rim in the housing;

a top reflective component positioned on top of said side and back reflective components; and a pair of springs connected to said top reflective component to bias it down on said side and back reflective components.

13. A housing for a luminaire as claimed in claim 12 wherein said first and second holding means comprise:

back mounting bracket means to receive the back ends of said first and second side reflective components, said bracket means also having said back reflective component mounted thereon;

a first retaining flange to receive the front end of said first side reflective component; and a second retaining flange to receive the front end of said second side reflective component.

14. A housing for a luminaire as claimed in claim 13 wherein said back mounting bracket means comprises:

a first bracket member secured to the housing to receive the back end of said first side reflective component; and a second bracket member spaced from said first bracket member and secured to the housing to receive the back end of said second side reflective component.

15. A housing for a luminaire as claimed in claim 13 wherein said first and second retaining flanges have a portion cut out to permit grasping of the front edges of said first and second side reflective components for removal of said side reflective components from the housing.

* * * * *